United States Patent [19]

Kuehnle et al.

[11] Patent Number: 4,521,097

[45] Date of Patent: Jun. 4, 1985

[54] ELECTROPHOTOGRAPHIC IMAGE RECORDING METHOD AND APPARATUS

[75] Inventors: Manfred R. Kuehnle, New London, N.H.; George J. Perry; Robert M. Rose, both of Sudbury, Mass.

[73] Assignee: Coulter Systems Corporation, Bedford, Mass.

[21] Appl. No.: 423,020

[22] Filed: Sep. 24, 1982

[51] Int. Cl.[3] ..... G03G 15/22

[52] U.S. Cl. ..... 355/3 R; 355/15; 430/126

[58] Field of Search ..... 355/3 R, 3 TR, 3 FU, 355/10, 15; 430/126

[56] References Cited

U.S. PATENT DOCUMENTS

| | | | |
|---|---|---|---|
| 3,040,621 | 6/1962 | Crumrine | 355/3 R |
| 3,722,993 | 3/1973 | Egnaczak | 355/10 X |
| 3,725,059 | 4/1973 | Komp | 355/15 X |
| 3,880,512 | 4/1975 | Kuehnle | 355/3 R |
| 3,936,178 | 2/1976 | Kuehnle | 355/5 |
| 4,392,734 | 7/1983 | Plumadore | 355/3 R |

*Primary Examiner*—Fred L. Braun

*Attorney, Agent, or Firm*—Silverman, Cass & Singer, Ltd.

[57] ABSTRACT

An electrophotographic method and apparatus for recording micrographic images as high resolution positive or reversal transparencies. Plural planar reusable electrophotographic plates are mounted for stepwise movement sequentially along a path for a cycle of successive operations, each plate being sucessively sequentially charged, exposed to a projected micrographics image to form a latent charge image thereof, said charge image toned, the toned image dried and contact transferred under application of heat and pressure by lamination to a transparent substrate, the lamination separated and the plate cleaned and discharged subsequent to separation for reuse. The transparency carrying the micrographics image embedded therein is mounted on a suitable holder.

The apparatus includes a rotor for mounting the plates about its circumference and a framework for mounting the functional stations positioned about the rotor circumference in operative condition relative the plates mounted on said rotor. A stepping motor or other incremental-type drive drives the rotor in a programmed movement. The framework and rotor are surrounded by a light-tight housing. A suitable aperture is provided in the housing to enable an exterior projector to direct a micrographics image to the charged photoconductive surface of the plate. A transfer station includes feed, guide and storage as a self contained unit, including both heating and pressure units for laminating the plate carryng the toner image and the transparent substrate.

36 Claims, 9 Drawing Figures

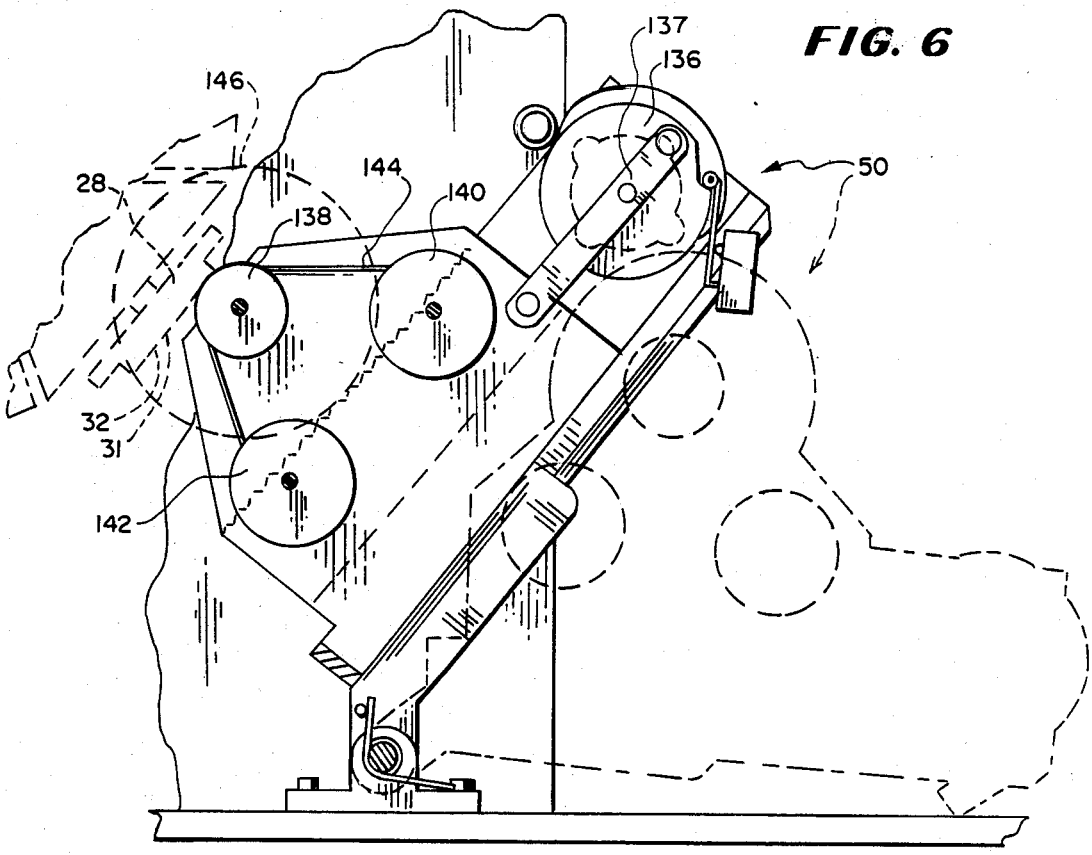
FIG. 6
FIG. 7
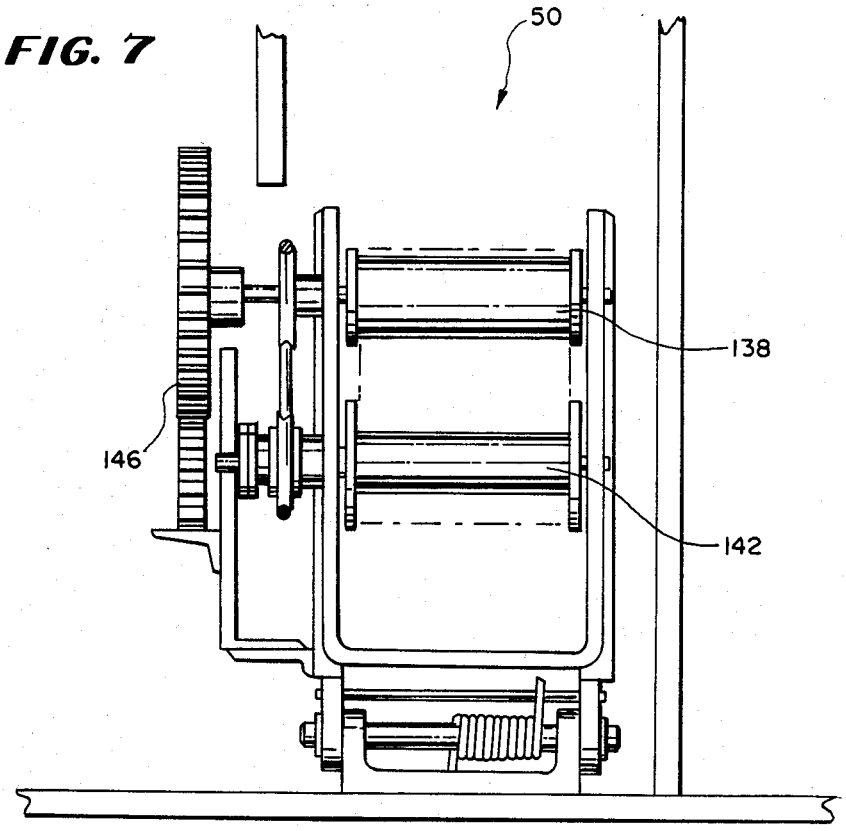

ELECTROPHOTOGRAPHIC IMAGE RECORDING METHOD AND APPARATUS

RELATED PATENTS AND PATENT APPLICATIONS

The invention herein is related to the subject matter disclosed in the following U.S. Pat. Nos.:

4,025,339 granted May 24, 1977, issued to Manfred R. Kuehnle and entitled "ELECTROPHOTOGRAPHIC FILM, METHOD OF MAKING SAME AND PHOTOCONDUCTIVE COATING USED THEREWITH" and 4,269,919 granted May 26, 1981, issued to Manfred R. Kuehnle and entitled "INORGANIC PHOTOCONDUCTIVE COATING ELECTROPHOTOGRAPHIC MEMBER AND SPUTTERING METHOD OF MAKING THE SAME".

The above-listed patents are hereby being incorporated by reference herein and owned by the assignee hereof.

Reference will be made herein to copending application:

Ser. No. 317,445 filed Nov. 2, 1981, by Martinez, entitled "IMAGE TRANSFER MATERIAL AND TRANSPARENCY RESULTING THEREFROM", and owned by the same assignee.

BACKGROUND OF THE INVENTION

The invention herein relates generally to an electrophotographic recording method and apparatus especially capable of recording micrographic images as high resolution positive or negative transparencies. More particularly the method and apparatus is embodied in a camera-processor that employs high resolution electrophotographic techniques to form a permanent image-carrying transparency suitable for mounting in a storage card, for example, the invention enabling the transfer processing to be carried out in normal light, and with unusual speed over known micrographics duplicator apparatus.

Micrographics is a general term used to denote the creation or use of information communication or storage medium containing images too small to be read without magnification, typified by microfilm. The micrographics may be reduced images of printed or other graphics, graphical design and the like for storage in the printed form and enlargement for printing or projection retrieval.

Conventionally the art of micrographics employs photographic technique using silver halide emulsion photographic film. Conventionally the photographic film is of high speed, fine grain, expensive both as to the value of their inherent silver content and in the processing technique required. Grain size, contrast, fogging are limiting factors in photographic reproduction of this type. The techniques of micrographics require fine grain photographic film in view of the substantial reduction in the size of the image and the substantial enlargement required for viewing as by projection or copying.

Photographic film of the type required generally require expensive chemicals and processing, as well as expenditure of time to process the exposed film to its usable form. Additionally photographic film, until exposed and developed, is light sensitive and often bulky, requiring special handling through processing and storage.

The conventional silver halide film of 140 microns thickness has an emulsion which is about 20 microns thick. The conventional silver halide film is thus not easily flexed without damage. Its resolution is determined by the size of the silver grains; the bigger the grain, the faster the film. In production, the film cannot be inspected in ordinary light, it cannot be handled or transported except in special dark packages. The emulsion is soluble in ordinary liquids and is hygroscopic.

Conventional photographic microfilm is not capable of being re-exposed for adding information. The inherent chemical nature of silver halide films results in an irreversible chemical change when the microfilm is exposed, even prior to the wet development process.

Electrostatic techniques such as xerography and electrofax processes as they are commonly-known are not readily adaptable to the production of micrographics or microfilm transparencies. Inherently, the familiar electrostatic processes are not adaptable for use in high speed photographic applications.

Known micrographics processsors employ photographic technique and film such as silver halide emulsion photographic film as the reproductive medium. Photographic film which forms the transparency is expensive and the time required for processing the film to the final form as the transparency is an undesirable factor of the known processors. Additionally, the photographic film requires special handling and storage in a light-tight container.

The most familiar xerographic process of the present time utilizes a large metal drum coated with amorphous selenium as the photoconductive member. The photoconductive member has extremely low gain and is very thick, of the order of a fraction of an inch, in order to be able to build up a sufficient charge to enable toning. Low surface potentials during charging require longer toning times. The process performed is complex, occurs in a complicated and expensive machine, and the speeds, resolution and flexibility of such machines and the processes thereof leave much to be desired. Electrofax equipment of the present time utilize zinc oxide coated conductive paper which is charged, exposed, led through a toner bath and fused. The photoconductive gain is again low, the resolution crude, the gray scale short and limited, the equipment complex and bulky.

Inherent faults with the known methods, apparatus and the photoconductive materials and articles used have prevented use in such fields as high resolution micrographics, high speed photography, and many other technical areas. Record-keeping, by means of projectable microfilm is a field wherein there is a long-felt need for a process for making the image-carrying transparency quickly, with high resolution, economically, with simple apparatus and having the ability to withstand long periods of storage.

Accordingly, it would be highly desirable to provide a method and apparatus for making an image-carrying transparency in which the transparency material is significantly less expensive and easier to handle, i.e., not light sensitive, having improved flexibility, etc.

Additionally, it is desirable to reduce processing time and eliminate expensive processing chemicals. Of considerable importance would be the capability to change or add to the developed microfilm.

The invention herein eliminates the expensive film and many processing steps while providing an improved recording that is effective for its intended use and importantly having the capability of altering the recording to add information from time to time without adversely affecting the information which is already contained thereon.

SUMMARY OF THE INVENTION

The invention herein provides a method for producing an image-carrying receptor of an original image. The method comprises the steps of providing a planar electrophotographic member having an outwardly facing photoconductive surface; applying a substantially uniform charge to the photoconductive surface; projecting a light pattern representative of the original image for a predetermined time, thereby forming a latent electrostatic image on said charging photoconductive surface; applying toner to the latent electrostatic image, thereby rendering the same visible; drying the photoconductive surface and the toner image thereon; transferring the toned image to a transfer medium utilizing locally applied heat and pressure; cleaning the photoconductive surface; and discharging the photoconductive surface.

The apparatus of the invention comprises a light-excluding housing, a stepwise translatable carriage disposed within said housing and means to provide a predetermined path for translation of said carriage, a plurality of stations disposed spaced along said path comprising a charging and imaging station, a toning station, a drying station, a transfer station, a cleaning station, and a discharge station, the apparatus including means for moving the carriage stepwise in a program, bringing the same to and past said stations in a predetermined sequence; said carriage having a plurality of platens mounted thereon and spaced apart by a predetermined distance; an electrophotographic member secured to each of the plurality of platens, said member having an outwardly facing photoconductive surface; a copyboard adapted to have an original image mounted thereon; means for charging the photoconductive surface; means for projecting a light pattern representative of the image-bearing original and shutter means cooperating to provide a predetermined exposure time, to form a latent electrostatic image of the pattern on the photoconductive surface; said toning station having means for applying toner to the latent electrostatic image to render the same visible; said transfer station having means for transferring the dry toner image to a transfer medium; said drying station having means for drying the toned image on the photoconductive surface; said cleaning station having means for cleaning the photoconductive surface subsequent to transferring the toned image therefrom, and said discharge station having means for discharging the photoconductive surface.

BRIEF DESCRIPTION OF THE DRAWINGS

FIG. 6 is a fragmentary elevational section illustrating the cleaning station;

FIG. 7 is a fragmentary top plan view of the apparatus of FIG. 6;

DESCRIPTION OF THE PREFERRED EMBODIMENT

Figure 1:
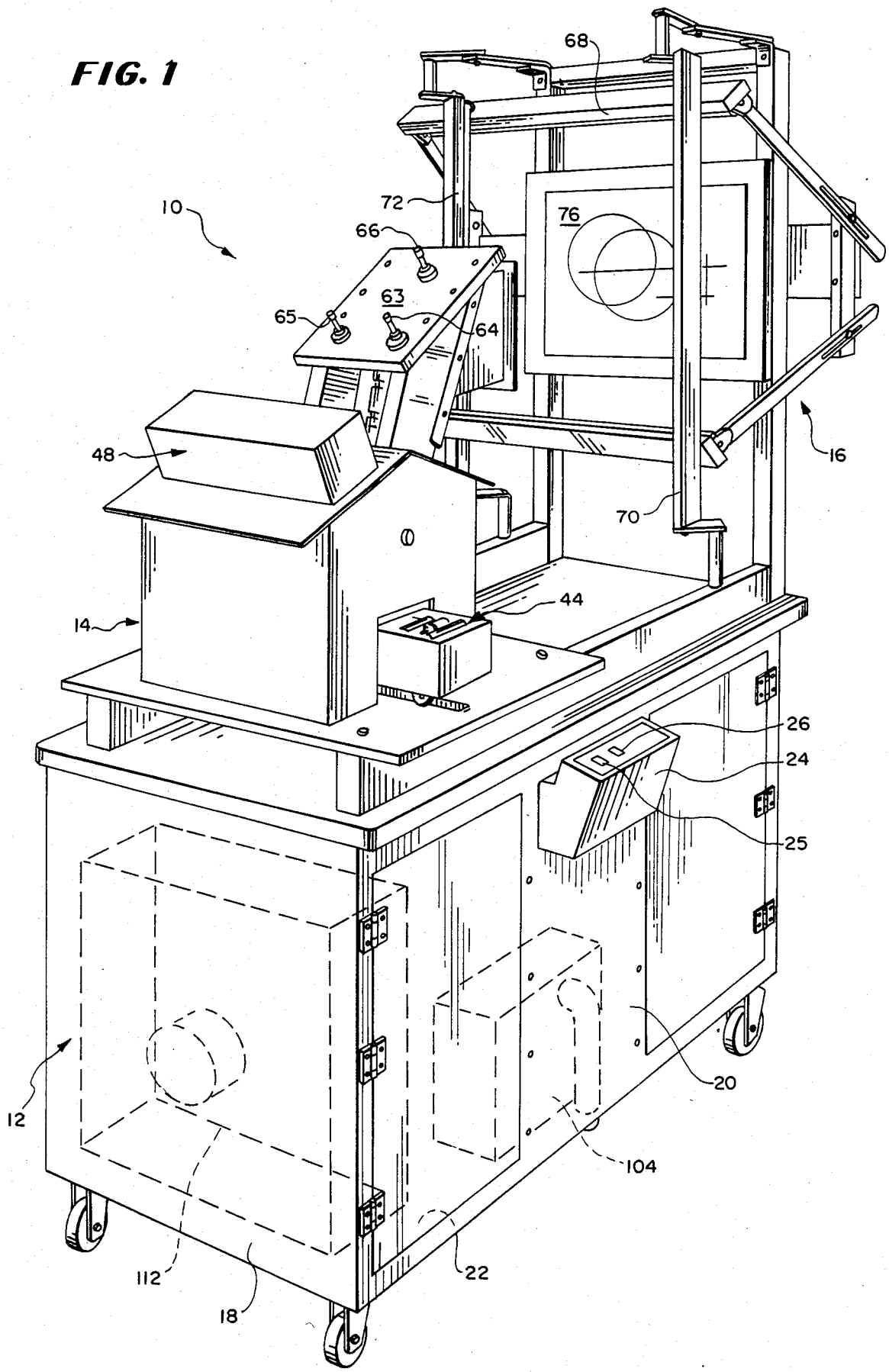
FIG. 1 is a perspective view of the micrographics camera-processor apparatus constructed in accordance with the invention.

Briefly, the invention provides a method and apparatus for imaging and processing micrographics employing electrophotographic technique wherein a high-resolution transparency is formed that is suitable for employment in standard microcopier and microfilm reader devices. The apparatus of the invention is suitable for daylight operation with all functional stations housed within a light-excluding enclosure. The micrographics image is formed on the photoconductive coating of a donor electrophotographic member and transferred to a transparent receptor medium to form the transparency.

The electrophotographic members employed in the invention are of the type having a photoconductive coating and high speed and high resolution capability. Preferably the patented electrophotographic member is employed herein. This member has a thin film coating of an inorganic, photoconductive, electronically anisotropic material, such as sputtered cadmium sulfide bonded to a thin film layer of ohmic material, and a substrate of a flexible plastic film such as clear polyester, and which has high-speed and high resolution capability. Stainless steel or the like can be used as an alternative to the substrate thereby providing a more durable electrophotographic member.

The transparency or transfer receptor medium comprises a substrate formed of sheet polymeric material having a thin overcoated layer bonded thereto, the overcoated layer is formed of a compatible resinous composition having a heat softening range less than the softening range of the substrate material. A preferred material for the transparency employed in the subject invention is described and claimed in U.S. patent application, Ser. No. 317,445 filed Nov. 2, 1981, by Martinez et al., entitled "IMAGE TRANSFER MATERIAL AND TRANSPARENCY RESULTING THEREFROM".

The transparency can include for example, a substrate of polyester material having an overcoating of a non-light sensitive plastic resin and thus does not require any special care. The transparency is pre-mounted in a rectangular aperture in a standard size micrographics aperture card and is clear and compatible with various types of existing micrographics machines.

The apparatus includes a plurality of electrophotographic members having a photoconductive surface facing outwardly, said members being individually secured to platens mounted on a carriage. For example, the platens can be provided at predetermined distance around the periphery of an imaging rotor for stepwise translation in the accurate path determined thereby. The plurality of electrophotographic members are provided on the platens for successive, sequential operations on the photoconductive surface of each of the electrophotographic members at the different functional stations thereby producing the transparencies faster. The electrophotographic members are reuseable and each is capable of producing many transparencies durings its useful life.

The functional stations are provided in operative position relative to the photoconductive surface of each of the electrophotographic members as the electrophotographic members travel in a path. Automatic sequential operation is provided through the respective functional stations for charging, imaging, toning, drying, transferring, cleaning, and discharging. The receptor or transfer medium such as the transparency is removed after the transfer function and replaced with a new transfer medium to receive the next micrographics image to be transferred.

Figure 2:
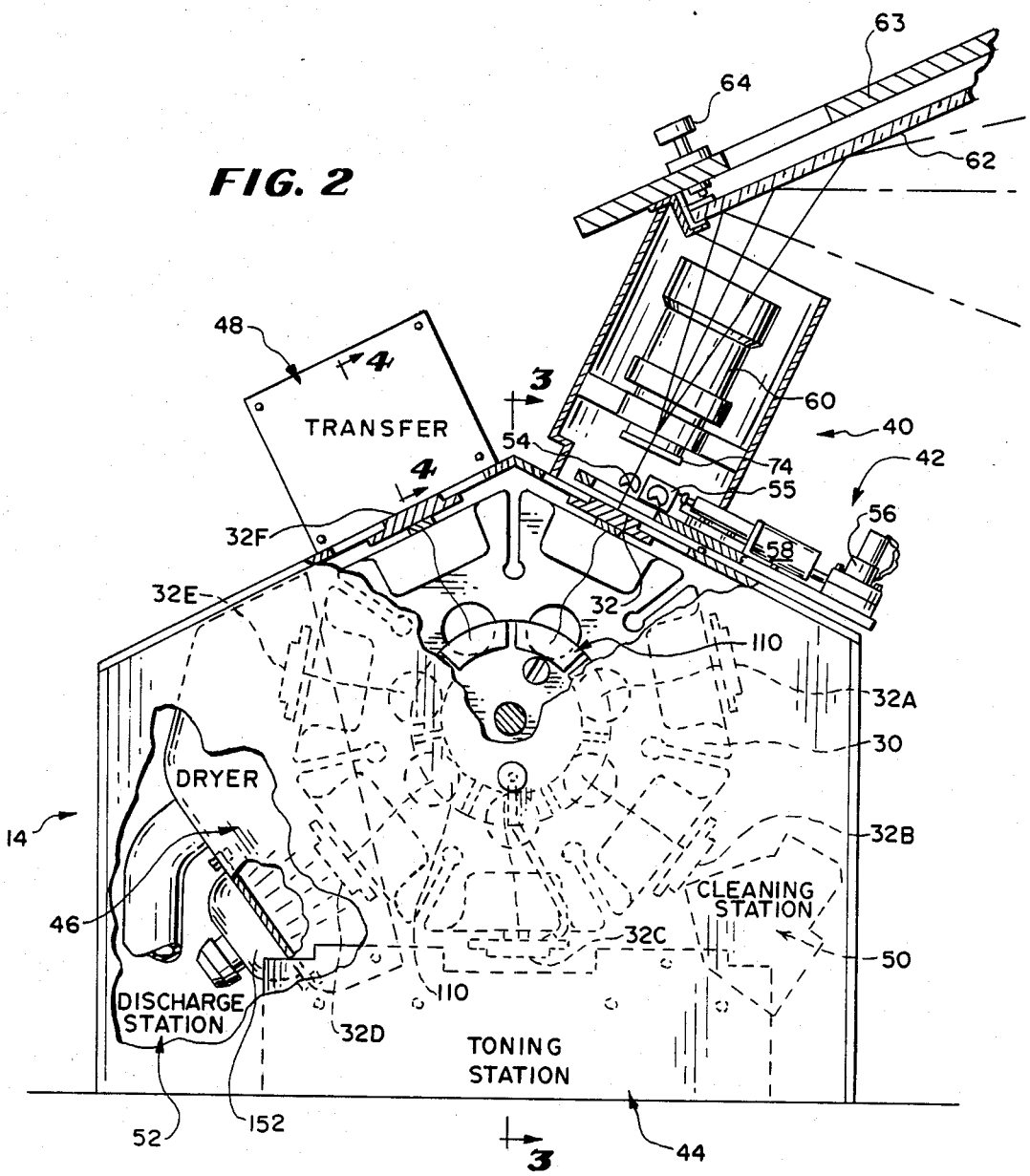
FIG. 2 is a fragmentary front elevational view of a portion of the apparatus of FIG. 1 with interior details shown in phantom.
Figure 3:
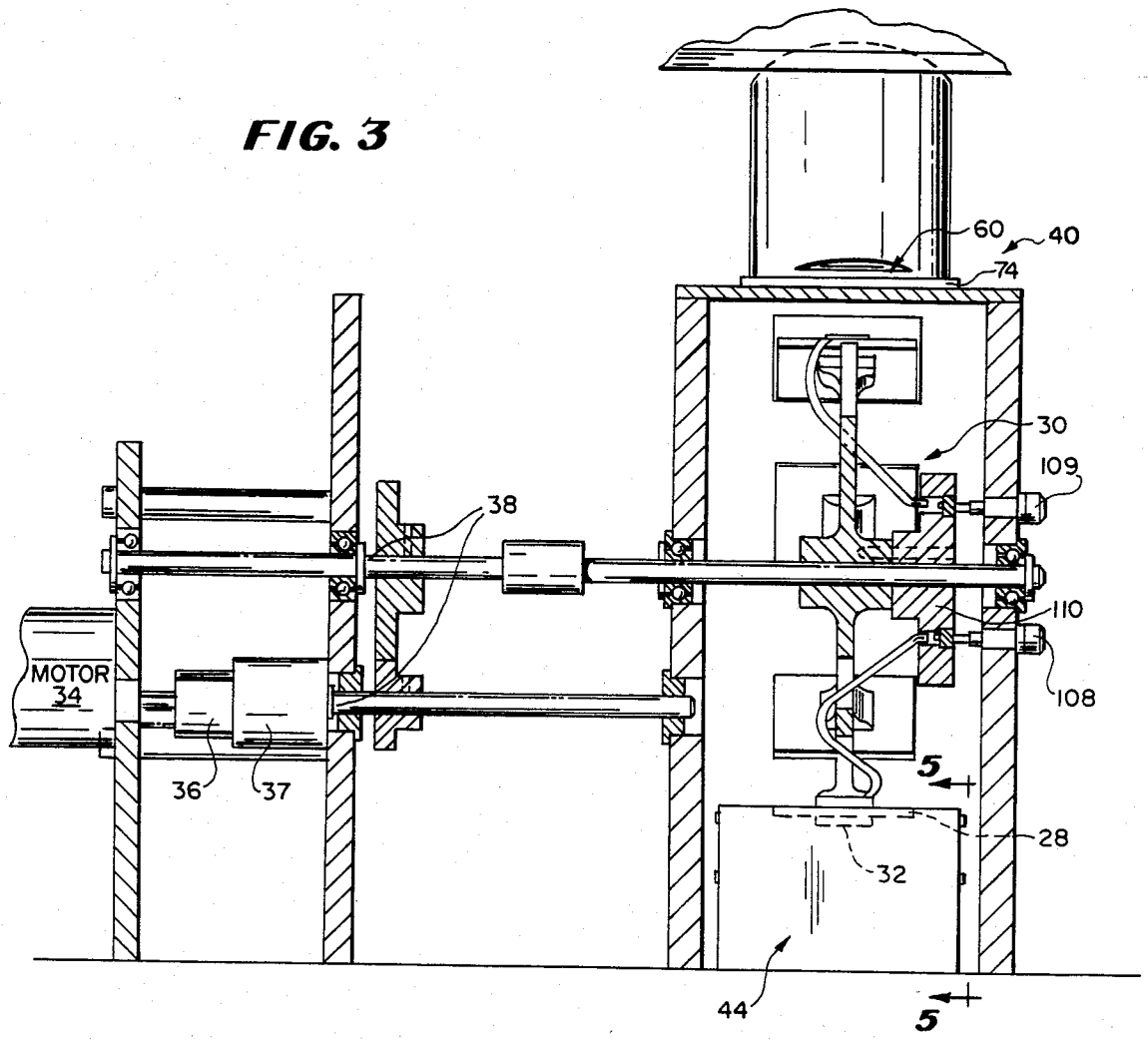
FIG. 3 is a fragmentary side elevational view along the line 3—3 of FIG. 2 and in the direction indicated.

Referring now to the drawings, FIGS. 1 to 3 inclusive, an electrophoto-micrographics camera processor 10 is illustrated as having a rectangular base housing 12, a light-excluding superstructure 14 and a copyboard assembly 16. The base housing 12 has opposite end walls 18, opposite side walls 20, and a floor 22. A control panel 24 is mounted on the front side wall 20 of the base housing 12 and includes a main power switch 25, a selection switch 26 for either a positive or reversal image and optionally can provide for other operator adjustments. The carriage is shown, for example, as an imaging rotor 30 that is disposed within the light-excluding superstructure 14. The drawings optionally illustrate the apparatus having seven electrophotographic members 32, 32A, 32B, 32C, 32D, 32E, 32F mounted separately equi-spaced around the periphery of the imaging rotor 30. The photoconductive surface 31 faces outwardly and is translated to operative position relative to the functional stations. The electrophotographic members 32, 32A, 32B, 32C, 32D, 32E, 32F are each mounted on platens 28 that are secured to the periphery of the imaging rotor 30. Each of the platens 28 are spaced apart along the periphery by approximately d/x, where d equals the diameter of the imaging rotor 30 and x equals the total number of electrophotographic members or, as illustrated in the drawings, seven members.

In view of the substantial identity of construction and operation of the electrophotographic members, only one member 32 need be described to afford a full understanding of all. However, it should be understood that the different functional operations respectively can be performed on all simultaneously at the various functional stations.

The sequential operations on the photoconductive surface 31 (shown in FIG. 8) of the electrophotographic member 32 are preprogrammed for automatic operation at the functional stations to be described hereinafter.

A motor 34 is coupled to the imaging rotor 30 through clutches 36, 37 and reduction gearing 38. The stepwise translation of the imaging rotor 30 is provided by continuously driving the motor 34 and clutch 36 being a torque limiting clutch and clutch 37 being a single revolution clutch that is activated by a solenoid. The reduction gearing 38 determines the fraction of a revolution translation of the imaging rotor 30 with each pulse activating the single revolution clutch 37. For example, the reduction gearing 38 can be provided with a ratio of 3:7, thereby providing a 3/7 revolution step with each incremental translation of the imaging rotor 30. That means that three incremental steps are taken for each translation from station to station.

Figure 8:
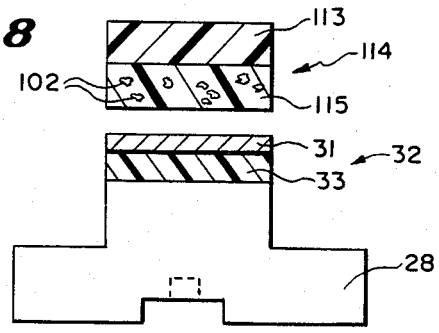
FIG. 8 is a fragmentary diagrammatic detail illustrating the platen structure for mounting an electrophotographic member.

The functional stations include an imaging station 40, a charging station 42, a toning station 44, a drying station 46, a transfer station 48, a cleaning station 50, and a discharge station 52. Referring to FIG. 2, there is illustrated the electrophotographic member 32 disposed at a first position proximate to the imaging station 40 and charging station 42. The charging station 42 is constructed and arranged to enable a corona generating means 54 to be translated across the photoconductive surface 31 and returned to a home position to the side of the electrophotographic member 32. The charging station 42 includes a carriage drive motor 56 that translates the corona generating wire 54 spaced in close proximity above the photoconductive surface 31. A high voltage supply (not shown) is connected to the corona generating wire 54 thereby an electrostatic corona effect occurs as the generating wire 54 is moved in proximity to the photoconductive surface 31. A motor 58 is coupled to the corona generating wire 54 causing the corona generating wire 54 to oscillate longitudinally and thereby produce a substantially uniform charge on the photoconductive surface 31. A electrostatic shield 55 is provided above the corona generating wire 54. The carriage drive motor 56 causes the corona generating wire 54 to be translated over the photoconductive surface 31 and then away from the electrophotographic member 32 after the photoconductive surface 31 has been charged. Referring to FIG. 8, the electrophotographic member 32 is shown secured to a platen 28. The electrophotographic member 32 comprises an ohmic substrate 33 and the photoconductive surface 31. During the charging function, a grounding potential is applied to the ohmic substrate 33 of the electrophotographic member 32.

The imaging station 40 is disposed above the charging station 42 whereby the photoconductive surface 31 may be exposed at the same position of the imaging rotor 30 as for the charging function. At the imaging station a light pattern is projected onto the charged phtotoconductive surface 31, the charge pattern which is produced on the photoconductive surface comprises a latent electrostatic image of the light pattern. The imaging station 40 includes a lens 60, a shutter mechanism 74, a mirror 62 and a copyboard assembly 16. The copyboard assembly includes lamps 68, 70, 72, which project light onto an original document 76. The light is reflected from the original document and is directed by mirror 62 and the lens 60 onto the photoconductive surface 31 to cause a light pattern in the form of an image of original document 76 to be projected onto the photoconductive surface 31. The shutter mechanism 74 is provided in light-intercepting relationship with the lens 60 and permits light passage only during the exposure time. The shutter mechanism 76 is in light-blocking relationship to the electrophotographic member 32 during the charging and the toning functions. The mirror 62 is mounted to a structure 63 that has adjusting mechanism 64, 65, 66 provided to enable fine adjustment of the angular position of the mirror 62 relative to the lens 60. The lens 60 can be an f/6, 65 mm focal length lens, such as the type sold by Olympus Corporation. The lamp 68, 70, 72 can be a fluorescent type rated for about 44 watts, and providing illumination of the copy board of about 250 foot-candles.

Figure 5:
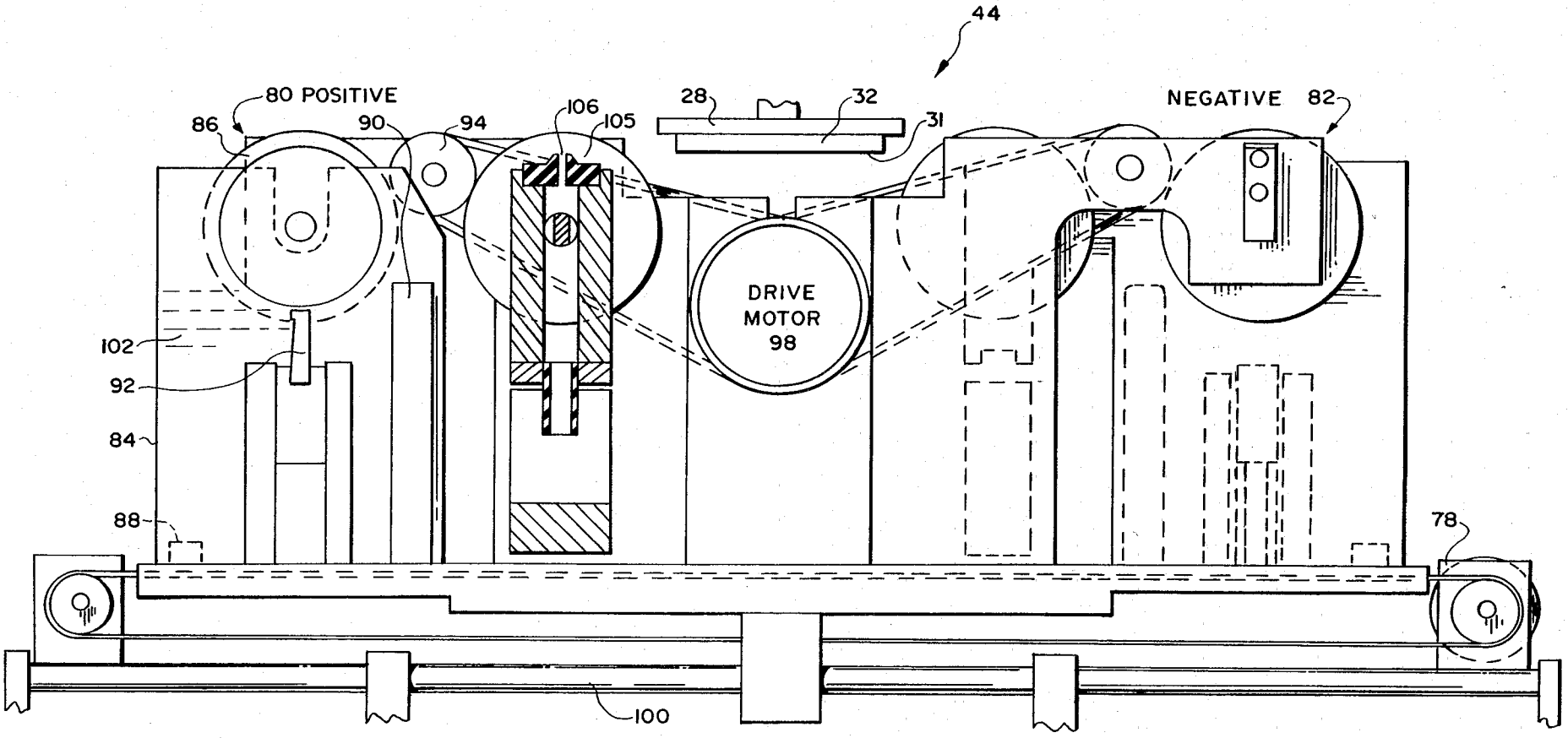
FIG. 5 is a fragmentary elevational section illustrating the toning station.

The imaging rotor 30 is translated stepwise to a second position where the electrophotographic member 32 is disposed above the toning station 44. At the toning station 44, toner particles are distributed over the photoconductive surface 31 thereby rendering the latent charge image visible by selecting depositing in the exposed or unexposed areas to create a positive or reversal image, depending on the toner composition. Referring to FIG. 5, the toning station 44 is illustrated relative to the electrophotographic member 32. The toning station 44 provides for toning with either positive or negative toner particles. The toner particles are charged electrophoretically by suspension of these particles in a suitable dispersant, such as an electrically insulating fluid. The electrically insulating fluid may be a narrow cut isoparaffinic hydrocarbon fraction sold by Exxon Company of Houston, Tex. under the registered trademark of ISOPAR. Alternatively, the toner particles can be applied in a powder or dry condition. The liquid toner offers improved resolution due to the smaller size of the dispersed toner particles than in a dry or powder toner. The toning station 44 is arranged for translation along rail 100 driven through sprocket and chain by motor 78 whereby one of the positive or negative toner supplying rollers is disposed in operative position relative to the photoconductive surface 31. The toning station 44 includes a positive toning module 80 and a negative toning module 82. The positive and reversal toning modules 80, 82 are substantially identical in construction, each including a sump 84, a toning roller 86, a spacing roller 105, a vacuum source 106, a toner inlet port 88, a toner outlet or drain port 90, a doctor blade 92, a drive gear 94 coupled to a pulley 96 that is coupled to a common drive motor 98. In view of the close identity of construction of these toning modules only the positive toning module 80 need be described to afford a full understanding of both.

The liquid toner 102 is continuously circulated through the sump 84 and a reservoir (not shown) thereby maintaining the toner particles properly dispersed within the electrically isolative liquid dispersant. A pump 104 shown in FIG. 1 in phantom within the base housing 12 is connected to the primary inlet port 88 and acts to continuously circulate the toner through the sump 84 and the reservoir (not shown) within the base housing 12. The toning roller 86 is caused to rotate by the drive gear 94 and dips into the sump of toner 102. The toner outlet or drain port 90 is provided as a stand pipe thereby establishing the level of toner 102 within the sump 84. The doctor blade 92 helps clean the toner roller 86. The carriage drive motor 78 translates the toner module past a vacuum source 106 to remove any stray toner particles in non-imaged areas. A spacing roller 105 acts to maintain a predetermined gap between the toning roller 86 and the photoconductive surface 31.

The liquid toner 102 contains toner particles having an electrical charge polarity preserved in the dispersant. Minute residual potentials or noise voltages attract small ramdom amounts of the charged toner particles, the result can be an overall image background fog from stray toner particles in non-image areas. A bias voltage is effected between the toning roller 86 and the electrophotographic member 32 which serves to minimize residual toner background fog. The bias voltage source 108 is connected through slip ring assembly 110 shown in FIGS. 2 and 3 to the ohmic substrate 33 of the electrophotographic member 32. The bias voltage is a positive DC, or negative DC voltage between 0 and 10 volts. The slip ring assembly 110 is illustrated in FIG. 2 as having seven electrically separate segments corresponding to the seven platens to enable providing a bias voltage at 108 in FIG. 3 during the toning function and applying a grounding potential at 109 in FIG. 3 during the charging function to the electrophotographic member 32.

After the toning function is completed, the imaging rotor 30 is driven by motor 34 to a third position such that the electrophotographic member 32 is disposed proximate to the transfer station 48. During this translation the photoconductive surface 31 of the electrophotographic member 32 passes the dryer station 46 and the surface 31 is dried by the hot air provided thereby. A hot air blower fan 112 shown in FIG. 1 in phantom enclosed within the base structure 12 provided the hot air to the dryer station 46.

At the transfer station 48, the toner image on the photoconductive surface 31 is transferred to a transfer medium, such as transparency 114 which is disposed in a micrographics aperture card 116. Alternatively, the transfer medium could be a sheet for example, as for microfiche or a roll for micro-form conveniently may be employed. The micrographics aperture card 116 is a standard tabulating-size card with the transparency 114 mounted in a rectangular aperture therein. The transparency 114 is brought into intimate engagement with the photoconductive surface 31 of the electrophotographic member 32 having the dry toner image developed on the photoconductive surface 31 thereof, laminated together under the influence of heat and pressure to form a laminate and the laminate is separated to provide the transparency consisting of the toner embedded in the resinous coating of the transparency.

Figure 4:
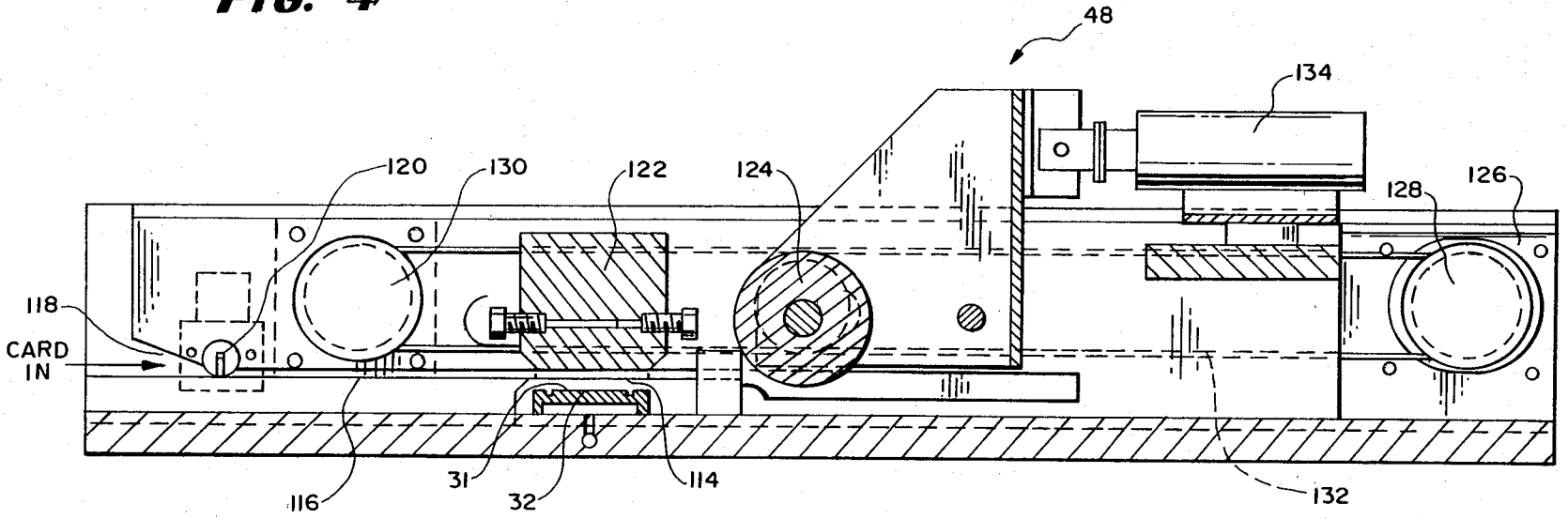
FIG. 4 is a fragmentary elevational section along the line 4—4 of FIG. 2 and in the indicated direction illustrating the transfer station.

The transfer station 48 is illustrated in FIG. 4. The micrographics aperture card 116 is fed into a slot 118 within the transfer station assembly. A solenoid activated pin 120 is elevated thereafter to hold the aperture card 116 in place while the transfer of the toner image is effected.

A preheat block 122 is disposed above the engaged transparency 114 and photoconductive surface 31. The block 122 is heated to about 170 degrees C. As shown in FIG. 4, a carriage drive motor 126 moves a transfer roller 124 from right to left over the laminate through sprocket and chain with belt 132 and pulleys 128, 130. The transfer roller 124 further provides heat and applies a pressure in the range of 30 through 60 pounds per linear inch to the engaged transparency 114 and electrophotographic member 32. A motor 134 lifts the transfer roller 124, thereafter the transfer roller 124 is moved back to its original position. The electrophotographic member 32 separates from the transparency 114 with the transparency 114 having the toned image embedded in the overcoat thereof. The transfer roller 124 may be formed of metal or of a hard rubber of about 80 durometer. The aperture card 116 is removed from the slot 118 with the transparency 114 carrying the micrographics image thereon.

The imaging rotor 30 is motor-driven to translate the electrophotographic member 32 into proximity with the cleaning station 50. The cleaning station 50 is illustrated in FIGS. 6 and 7. Here, any remaining toner particles on the photoconductive surface 31 are removed, as by wiping any remaining toner 102 from the photoconductive surface 31 so that the electrophotographic member 32 is made ready for reuse. A cleanining station carriage motor 136 is coupled through a connecting linkage 137 to the cleaning station assembly and acts to move a cleaning roller 138 into and out of functional relationship with the photoconductive surface 31.

Referring to FIG. 6, the cleaning station assembly 50 is illustrated in the functional position and in phantom in a home position which is out of functional relationship with the photoconductive surface 31. The cleaning station carriage motor 136 is activated to move the cleaning roller 138 into operative position relative to the photoconductive surface 31. A web material 144 is supplied by a feed roller 140, across the cleaning roller 138 and to a take-up roller 142. The web material 144 may be various types of cloth or paper material. A gear mechanism 146 causes the web material 144 to advance with each successive electrophotographic member 32 for the cleaning thereof.

The imaging rotor 30 is motor-driven to translate the photoconductive surface 31 of the electrophotographic member 32 past the discharge station 52. The discharge station 52 includes a lamp 152. The discharge lamp 152 is a high intensity bulb, such as either an incandescent type or a fluorescent type rated for about 30 watts. The lamp 152 acts to fully discharge the photoconductive surface 13 and ready the electrophotographic member 32 for the next imaging cycle.

Figure 9:
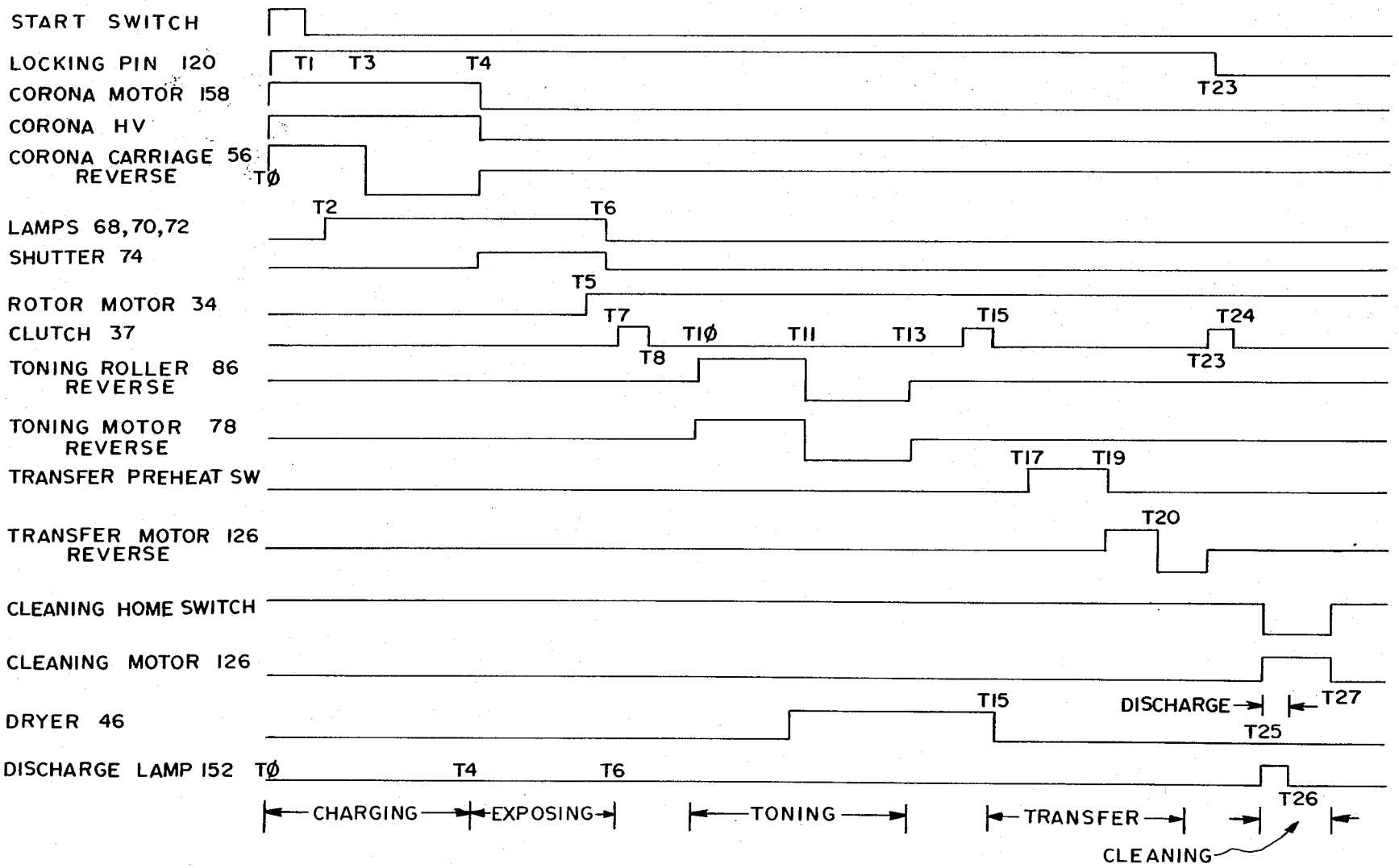
FIG. 9 is a timing diagram showing the operation of the apparatus according to the invention.

Attention is now directed to the chart of FIG. 9 which graphically represents the timing of the events involved in the operation of the apparatus 10 according to the invention.

The operator desiring to make a transparency first would turn on the power with switch 25 at the time TØ and install the original document 76 onto the copyboard assembly 16. The separate positive and negative toning modules 80, 82 have been loaded with the correct liquid toners 102. A time delay is effected at the initial start-up of the apparatus of the invention to enable the pre-heat block 122 and the heated transfer roller 124 to reach their predetermined temperatures. The operator would make a selection for either a positive or reversal image to be carried by the transparency 114 with one of the positions of switch 26. An aperture card 116 is inserted into slot 118 of the transfer station 48. The solenoid activated pin 120 is activated to lock the aperture card 116 in position. The corona oscillator motor 58 is activated to cause the corona were 54 to oscillate. At time TØ the corona high voltage supply is activated thereby effecting a corona discharge from the corona wire 54.

At the time T1 the momentary start switch is deactivated and at time T2 the exposure lamps 68, 70, 72 are energized, while the shutter mechanism 74 is provided in a closed, light-intercepting position. During the period between the time TØ and the time T3 the corona carriage motor 56 drives the corona assembly in a direction from right to left over the photoconductive surface 31, thereby charging the surface 31. At the time T3 the corona carriage motor 56 is reversed to move the corona assembly in the reverse direction further charging the photoconductive 31 in a second pass thereacross. The motors 56,58 are deactived at time T4 with the corona assebmly disposed at a home position and the corona high voltage supply is deactivated.

The charging function extends from the time TØ to the time T4. The electrophotographic member 32 remains at the same first position for exposing the photoconductive surface 31 to a light pattern to form a latent electrostatic image of the pattern representative of the image carried by original document 76 thereon.

The exposure function extends from time T4 to the time T5. At time T4 the shutter mechanism 74 is opened to allow passage of reflected light from the mirror 62 through the lens 60 and onto the photoconductive surface 31. At the time T5 the shutter 74 is returned to the closed, light-intercepting position. At time T6 the exposure lamps 68, 70, 72 are de-energized. The imaging rotor motor 34 driving the imaging rotor 30 is activated at time T5 with the completion of the exposure function. The single revolution, solenoid-activated clutch 37 is activated by a momentary pulse extending from the time T7 to the time T8 and the electrophotographic member 32 is translated to the second position over the toning station 44.

The toning function is provided substantially between the time of T10 and the time T13. The initial operator selection for a positive or negative image to be produced on the transparency determines the direction of movement of the toning assembly 44, such that one of the positive or negative toning modules 80, 82 is disposed in operative position relative to the photoconductive surface 31. As illustrated, at time T10 the common drive motor 98 and the toner carriage motor 78 are activated to move in a forward direction. Both motors 98 and 78 are reversed at time T11 and are driven in a reverse direction until the time R13 when they are deactivated.

The motor-driven toning roller 86 carries the liquid toner 102 onto the latent electrostatic image on the photoconductive surface 13 while the bias voltage is effected therebetween. The vacuum source 106 is activated from the time T11 to the time T13 during the return translation of the toner assembly and acts to remove any unattached toner particles 102 from the background of the toner image on the photoconductive surface 31.

At the time T11, the dryer blower fan 112 is energized thereby providing hot air to the dryer station 46. The single revolution clutch 37 is pulsed between the time T14 to the time T15 and the imaging rotor 30 is moved thereby to a third position such that the electrophotographic member 32 is disposed under the transfer station 48. The photoconductive surface 31 of the electrophotographic member 32 is dried by the hot air as it is translated past the dryer station 46. The hot air blower fan 112 is de-energized at the time T15.

The photoconductive surface 31 is disposed in functional position relative to the transfer station 48 at the time T17. The transfer function is provided between the time of T17 and T23. The transfer preheat block 122 is disposed over the engaged transparency 116 and photoconductive surface 31 between the time T17 to the time T19. At the time T19 the transfer carriage motor 126 is activated to move the transfer assembly forward such that the transfer roller 124 is disposed over the engaged transparency 116 and photoconductive surface 31. The transfer roller 124 applies further heat and pressure between the time T19 to the time T20. At the time T20 the lift motor 134 is activated and acts to raise the transfer roller 124 to an elevated position and the transfer carriage motor is reversed to move the transfer assembly back to the home position. The transfer assembly is at the home position at the time T23. The transparency 116 is separated from the photoconductive surface 31 at the time T20 with the toned image embedded in the overcoated layer 115 of the transparency 116. At the time T23 the locking pin 20 that holds the aperture card 114 in place during transfer is de-activated whereby the aperture card 114 can be removed and a new card 114 then be inserted into the slot 118 in the transfer assembly 48.

Between the time T23 and the time T24 a pulse is provided to activate the single revolution clutch 37 and the imaging rotor 30 is moved to the cleaning station 50. The cleaning station carriage motor 126 is activated during the period from the time T25 to the time T27. The cleaning roller 138 is disposed in operative contact with the photoconductive surface 13 to wipe any remaining toner particles 102 therefrom. The discharge lamp 152 is energized at the time T25 and de-energized at the time T26 to illuminate and fully discharge the photoconductive surface 31 and ready the electrophotographic member 32 for reuse. At the time T26 the cleaning station carriage motor is de-activated and the cleaning roller 138 is moved back to the home position, as is illustrated with the cleaning home switch line of FIG. 9, so that the cleaning station 50 is disposed out of functional relationship with the electrophotographic members 32, 32A, 32B, 32C, 32D, 32E, 32F, as the members are translated in the path with the movement of the imaging rotor 30.

As viewed in FIG. 2, one will appreciate that there is illustrated the rotor 30 mounting the electrophotographic plates on the circumferential wall thereof with the photoconductive coating thereof facing outward. Seven plates are provided spaced equally about the rotor, the functional stations mounted on the framework at locations also spaced about the periphery of the rotor so that as the rotation of the rotor 30 proceeds, the electrophotographic plates are brought sequentially into operational relationship with the functional stations. The arc of steps of rotation of the rotor is governed by the increments of rotation required to move one step clockwise as described and illustrated. Note that translation of the electrophotographic plates from station to station as illustrated will require three steps of rotation of rotor 30. This will take the charged member three steps of rotation to be translated from the charge and imaging station clockwise to the toning station (at six o'clock). Three step increments or steps of rotation of rotor 30 is required to translate the member that was imaged to the toning station. The member which was at the toning station is simultaneously translated stepwise three steps to place same at the transfer station, the drying being performed during the member (32*c*)'s translation to the transfer station, said member (32*c*) passing the drying station so that it arrives at the transfer station in dry condition. Simultaneous with the imaged member's translation to the toning station, the member which was at the transfer station is translated in the three step movement to reside at the cleaning station. The member which was at the cleaning state is translated to the discharge station. The member which was at the discharge station now appears at the imaging station. Each 3/7 stepwise translation results in the following:

| | Static | 1st Transl. 3 steps of rotation | 2nd Transl. 3 steps of rotation | 3rd Transl. 3 steps of rotation | 3rd Transl. 3 steps of rotation |
|---|---|---|---|---|---|
| 32 | Imaging | Toning | Transfer | Cleaning | Transit |
| 32A | Home | Dis-charge | Imaging | Toning | Transfer |
| 32B | Cleaning | Transit | Home | Discharge | Imaging |
| 32C | Toning | Transfer | Cleaning | Transit or ready | Home |
| 32D | Discharge | Imaging | Toning | Transfer | Cleaning |
| 32E | Transit | Home | Dis-charge | Imaging | Toning |
| 32F | Transfer | Cleaning | Transit | Home | Discharge |

We assume for the purpose of discussing the full and most advantageous simultaneously effected functions. All of these functions of imaging, toning, transit, cleaning happen all at the same time on different plates but in a regulated sequence relative each plate. Although all the different functions can occur simultaneously, the rotor steps three times (seven for translation from station to station). This is clear from FIG. 2 and amplified from the Table. That plate which was imaged is toned simultaneously as another plate is imaged. That which was toned is transferred, the image therein being dried in transit. All functions can occur simultaneously. The particular plate on which a function is to be effected is brought to the necessary station in "ready to be operated on" condition.

The method and apparatus of the subject invention provides for the successive and sequential operations on the photoconductive surface of each of the plurality of electrophotographic members at the above-described functional stations whereby transparencies are produced rapidly. The transparency 116 is handled in ambient light without performance sacrifice. The apparatus 10 of the invention provides for daylight operations.

Many variations are capable of being made without departing from the spirit or scope of the invention as defined in the appended claims.

What it is desired to be secured by Letters Patent of the United States is:

1. A method of producing an image-carrying receptor of an original image comprising:

i. providing a planar electrophotographic member having an outwardly facing photoconductive surface, ii. applying a substantially uniform charge to the photoconductive surface;

iii. projecting a light pattern representative of the original image for a predetermined time, thereby forming a latent electrostatic image on said charged photoconductive surface;

iv. applying toner to the latent electrostatic image, thereby rendering the same visible;

v. drying said photoconductive surface;

vi. transferring the toner image to a transfer medium by:

(a) providing a transfer medium consisting of a substrate carrying a thin heat softenable resin overcoat layer bonded thereto;

(b) bringing together the photoconductive surface of the electrophotographic member carrying the dry toner image and the overcoat layer of the transfer medium in contact engagement;

(c) applying heat and pressure to the engaged layer and surface softening said layer, thereby embedding the toner image within the overcoat layer;

(d) releasing the engaged transfer medium from the photoconductive surface; and vii. readying the photoconductive surface for reuse after the transfer is completed.

2. The method as claimed in claim 1 and the step of removing and replacing the transfer medium subsequent to the transferring of said toned image thereto.

3. The method as claimed in claim 1 and providing a plurality of said electrophotographic members, and successively repeating steps i through vii inclusive sequentially on each of said electrophotographic members.

4. The method as claimed in claim 1 in which the step of readying includes discharging any residual charge on the photoconductive surface subsequent to transfer of the toner image therefrom.

5. The method as claimed in claim 1 and the step of readying includes cleaning the photoconductive surface subsequent to transfer of the toner image therefrom.

6. The method as claimed in claim 5 wherein the step of cleaning the photoconductive surface includes:

i. advancing a predetermined length of a web material from a feed roller over a rotatable cleaning roller to a take-up roller, ii. bringing said rotatable cleaning roller into cleaning engagement with said photoconductive surface, thereby wiping off any toner therefrom and;

iii. moving the cleaning roller to a home position spaced from the path of the electrophotographic member.

7. The method as claimed in claim 1 wherein the step of applying toner to the latent electrostatic image includes:

i. loading a positive toning module with positive polarity liquid toner and loading a negative toning module with a negative polarity liquid toner, each of said toning modules having a rotatable development electrode mounted thereon such that said electrode being partially immersed within said liquid toner, ii. selecting one of moving the selected one of said toning modules proximate to the photoconductive surface, iii. applying a low D.C. voltage between the electrophotographic member and said development electrode to effect a bias field therebetween;

iv. establishing a gap between said electrode and said electrophotographic member, and v. rotating said development electrode and translating said electrode across said photoconductive surface.

8. The method as claimed in claim 7 and the step of moving a vacuum means past the photoconductive surface subsequent to the translation of said development electrode thereacross.

9. The method as claimed in claim 1 and the step of preheating the transfer medium to soften the overcoated layer.

10. A method of producing an image-carrying receptor of an original image comprising:

i. providing a stepwise translatable carriage, ii. providing at least a pair of planar electrophotographic members, each having an outwardly facing photoconductive surface, iii. placing said electrophotographic members spaced apart on the stepwise translatable carriage, iv. stepwise translating said carriage in a predetermined path in a predetermined sequence past a plurality of functional stations distributed spaced apart along said path, and including a charging and imaging station, a toning station, a drying station, and a transfer station, v. applying a substantially uniform charge to the photoconductive surface at the charging and imaging station, vi. projecting a light pattern representative of the original image for a predetermined time, thereby forming a latent electrostatic image on said charged photoconductive surface at the charging and imaging station, vii. applying toner to the latent electrostatic image at the toning station thereby rendering the same visible by:

(a) providing at least one toner module at the toning station, the toner module having a source of liquid toner, a development electrode and an applicator electrode immersed in a source of liquid toner, (b) moving the selected toner module into toning proximity with the photoconductive surface of the electrophotographic member subsequent to arrival thereof at the toning station;

(c) applying a low DC voltage between the electrophotographic member and the development electrode;

(d) establishing a predetermined gap between the electrode and the electrophotographic member and effecting application of the liquid toner to said photoconductive coating;

viii. drying said photoconductive surface at the drying station, ix. feeding a transfer medium to the transfer station, said transfer medium comprising a substrate and a heat softenable overlayer bonded to the substrate, x. transferring the toner image to the overlayer of the transfer medium at the transfer station by (a) bringing together the photoconductive surface of the electrophotographic member carrying the dry toner image and the overlayer of the transfer medium in contact engagement;

(b) applying heat and pressure to the engaged layer and surface softening said layer, thereby embedding the toner image within the said layer;

(c) releasing the engaged transfer medium from the photoconductive surface;

xi. and readying the photoconductive surface for reuse after the transfer is completed, xii. the electrophotographic members being mounted and the stations spaced so that the carriage stepwise is translated at least three steps at a time from station to station whereby a fresh electrophotographic member is consistently positioned at the charging and imaging station for each translation of the carriage from station to station.

11. The method as claimed in claim 10 in which said step of readying includes the step of removing any foreign matter from said photoconductive surface which remains thereon subsequent to the transfer of the toned image therefrom.

12. The method as claimed in claim 10 in which said step of readying includes the step of a discharge station discharging any residual electrostatic charge which remains on said photoconductive surface subsequent to transfer of the toner image therefrom.

13. The method as claimed in claim 10 in which the plurality of functional stations include a cleaning station and a discharging station and the step of readying includes the steps of cleaning the photoconductive surface at the cleaning station and discharging any residual electrostatic charge at the discharging station, the cleaning and discharging effected after transfer and before charging and imaging.

14. A method of producing an image-carrying receptor of an original image comprising:

i. providing a planar electrophotographic member having an outwardly facing photoconductive surface, ii. applying a substantially uniform charge to the photoconductive surface;

iii. projecting a light pattern representative of the original image for a predetermined time, thereby forming a latent electrostatic image on said charged photoconductive surface;

iv. applying toner to the latent electrostatic image, thereby rendering the same visible;

v. drying said photoconductive surface;

vi. transferring the toner image to a transfer medium by (a) providing a transfer medium consisting of a substrate carrying a thin overcoated layer bonded thereto, (b) applying heat to the transfer medium, whereby the overcoated layer is softened;

(c) bringing together the electrophotographic member and the transfer medium, the overcoated layer of the transfer medium in contact engagement against the photoconductive surface;

(c) simultaneously applying heat and pressure to the engaged transfer medium and photoconductive surface, thereby embedding the toner image within the overcoated layer;

(d) releasing the transfer medium from against the photoconductive surface, vii. cleaning the photoconductive surface and viii. discharging the photoconductive surface.

15. The method as claimed in claim 14 and the step of drying includes moving vacuum means past the photoconductive surface subsequent to the application of toner.

16. The method as claimed in claim 14 wherein the step of cleaning the photoconductive surface includes:

i. advancing a predetermined length of a web material from a feed roller over a rotatable cleaning roller to a take-up roller, ii. bringing said rotatable cleaning roller into cleaning engagement with said photoconductive surface, thereby wiping off any toner therefrom and;

iii. moving the cleaning roller to a home position spaced from the path of the electrophotographic member.

17. A method of producing an image-carrying receptor of an original image comprising:

i. providing a stepwise translatable carriage, ii. providing at least a pair of planar electrophotographic members, each having an outwardly facing photoconductive surface, iii. placing said electrophotographic members spaced apart on the stepwise translatable carriage, iv. stepwise translating said carriage in a predetermined path in a predetermined sequence past a plurality of functional stations distributed spaced apart along said path, and including a charging and imaging station, a toning station, a drying station, a transfer station, a cleaning station and a discharge station, v. applying a substantially uniform charge to the photoconductive surface at the charging and imaging station, vi. projecting a light pattern representative of the original image for a predetermined time, thereby forming a latent electrostatic image on said charged photoconductive surface at the charging and imaging station, vii. applying toner to the latent electrostatic image at the toning station thereby rendering the same visible by:

(a) providing at least one toner module at the toning station, the toner module having source of liquid toner, a development electrode and an applicator electrode immersed in a source of liquid toner, (b) moving the selected toner module into toning proximity with the photoconductive surface of the electrophotographic member subsequent to arrival thereof at the toning station;

(c) applying a low DC voltage between the electrophotographic member and the development electrode;

(d) establishing a predetermined gap between the electrode and the electrophotographic member and effecting application of the liquid toner to said photoconductive surface;

viii. drying said photoconductive surface at the drying station, ix. feeding a transfer medium to the transfer station, said transfer medium comprising a substrate and a heat softenable overlayer bonded to the substrate, x. transferring the toner image to a transfer medium at the transfer station by:

(a) providing a transfer medium consisting of a substrate carrying a thin overcoated layer bonded thereto, (b) applying heat to the transfer medium whereby the overcoated layer is softened;

(c) bringing together the electrophotographic member and the transfer medium, the overcoated layer of the transfer medium in contact engagement against the photoconductive surface;

(d) simultaneously applying heat and pressure to the engaged transfer medium and photoconductive surface, thereby embedding the toner image within the overcoated layer;

(e) releasing the transfer medium from against the photoconductive surface, xi. cleaning the photoconductive surface at the cleaning station and discharging the photoconductive surface at the discharging station, xii. the electrophotographic members being mounted and the stations spaced so that the carriage stepwise is translated at least three steps at a time from station to station whereby a fresh electrophotographic member is consecutively positioned at the charging and imaging station for each translation of the carriage from station to station.

18. The method as claimed in claim 17 and the step of drying includes moving vacuum means past the photoconductive surface subsequent to the application of toner.

19. The method as claimed in claim 17 wherein the step of cleaning the photoconductive surface includes i. advancing a predetermined length of a web material from a feed roller over a rotatable cleaning roller to a take-up roller, ii. bringing said rotatable cleaning roller into cleaning engagement with said photoconductive surface, thereby wiping off any toner therefrom and;

iii. moving the cleaning roller to a home position spaced from the path of the electrophotographic member.

20. Apparatus for producing an image-carrying receptor of an original image comprising:

A. a light-excluding housing,

B. a stepwise translatable carriage disposed within said housing and means to provide a predetermined path for translation of said carriage, C. a plurality of stations along said path comprising a charging and imaging station, a toning station, a drying station and a transfer station, the apparatus including means for moving the carriage in a program bringing the same to and past said stations in a predetermined sequence, D. said carriage having a plurality of platens mounted thereon and spaced apart by a predetermined distance, E. an electrophotographic member secured to each of the plurality of platens, said member having an outwardly facing photoconductive surface, F. a copyboard adapted to have an image-bearing original mounted thereon, G. means for charging the photoconductive surface, H. means for projecting a light pattern representative of the original image and shutter means cooperating to provide a predetermined exposure time, to form a latent electrostatic image of the pattern on the photoconductive surface, I. said toning station having means for applying toner to the latent electrostatic image to render the same visible, J. said drying station having means for drying the photoconductive surface and the toner image carried thereby, K. said transfer station having means for transferring the dried toner image to a transfer medium, said means for transferring including (a) means for causing contact engagement between the transfer medium and said photoconductive surface, (b) means for applying heat and pressure to the engaged transfer medium and photoconductive surface whereby to soften the transfer medium and transfer the toner image to said transfer medium as an embedded toner image therein, and (c) means to release the transfer medium from the photoconductive surface, and L. means for readying the photoconductive surface for reuse subsequent to transfer of the toner image therefrom.

21. The apparatus as claimed in claim 20 and means for ejecting and replacing said transfer medium subsequent to transferring the toner image.

22. The apparatus as claimed in claim 20 wherein said carriage includes a stepwise translatable imaging rotor.

23. The apparatus as caimed in claim 22 wherein said plurality of platens are individually mounted, equispaced around the periphery of said imaging rotor.

24. The apparatus as claimed in claim 22 and means for stepwise translation of said rotor providing for sequential operations on said photoconductive surface at said plurality of stations along said path.

25. The apparatus as claimed in claim 20 werein said toning station includes a positive toning module and a negative toning module, and means for moving one of said toning modules proximate to the photoconductive surface, each of said toning modules having:

A. a sump adapted to carry a supply of liquid toner therein suitable for developing said latent image, B. a rotatable development electrode partially immersed in said sump, C. means for applying a low D.C. voltage between the electrophotographic member and said development electrode, D. means for establishing a gap between said member and said development electrode, E. means for rotating said development electrode thereby bring liquid toner onto its surface out of said sump, and F. means for translating said development electrode across the photoconductive surface whereby to develop said latent image.

26. The apparatus as claimed in claim 20 wherein said drying station includes a hot air blower.

27. The apparatus as claimed in claim 20 wherein said transfer station includes means for preheating the transfer medium.

28. The apparatus as claimed in claim 20 wherein said means for applying heat and pressure include a rotatable transfer roller.

29. The apparatus as claimed in claim 20 in which said means for readying comprise a cleaning station having means for removing any foreign matter from said photoconductive surface which remains thereon subsequent to the transfer of the toned image therefrom.

30. The apparatus as claimed in claim 29 wherein said cleaning station includes:

a. a rotatable cleaning roller, a feed-roller and take-up roller, b. a cleaning material carried by said cleaning roller, c. means for advancing a predetermined length of said cleaning material from said feed-roller over said cleaning roller to said take-up roller, d. means for bringing said cleaning roller into cleaning engagement with the photoconductive surface, e. means for driving said rotatable cleaning roller and, f. means for moving said cleaning roller to a home position spaced from said path of the electrophotographic member.

31. The apparatus as claimed in claim 20 in which said stations are distributed and said carriage is stepped at least three steps for each translation thereof from station to station at a time to present a fresh electrophotographic member to the charging and imaging station for each translation of the carriage.

32. The apparatus as claimed in claim 20 in which said means for readying comprise a discharge station having means for discharging any residual electrostatic charge which remains on said photoconductive surface subsequent to transfer of the toner image therefrom.

33. The apparatus as claimed in claim 32 wherein said discharge station includes a source of radiant energy.

34. The apparatus as claimed in claim 20 in which there is a cleaning station and a discharge station and said means for readying comprise cleaning means at said cleaning station capable of removing any foreign matter from said photoconductive surface remaining thereon subsequent to transfer of the toner image therefrom and means at said discharge station for discharging any residual electrostatic charge from said photoconductive surface.

35. Apparatus for producing an image-carrying receptor of an original image comprising:

A. a light-excluding housing,

B. a stepwise translatable carriage disposed within said housing and means to provide a predetermined path for translation of said carriage, C. a plurality of stations along said path comprising a charging and imaging station, a toning station, a drying station, a transfer station, a cleaning station and a discharge station, the apparatus including means for moving the carriage in a program bringing the same to and past said stations in a predetermined sequence, D. said carriage having a plurality of platens mounted thereon and spaced apart by a predetermined distance, E. an electrophotographic member secured to each of the plurality of platens, said member having an outwardly facing photoconductive surface, F. a copyboard adapted to have an image-bearing original mounted thereon, G. means for charging the photoconductive surface, H. means for projecting a light pattern representative of the original image and shutter means cooperating to provide a predetermined exposure time, to form a latent electrostatic image of the pattern on the photoconductive surface, I. said toning station having means for applying toner to the latent electrostatic image to render the same visible, J. said transfer station having means for transferring the toned image to a transfer medium, including (a) means for mounting the transfer medium in a disposition for contact engagement with said photoconductive surface when said electrophotographic member is positioned at said transfer station, (b) means for preheating the transfer medium, (c) means for causing contact engagement between the transfer medium and said photoconductive surface, (d) means for applying heat and pressure to the engaged transfer medium and photoconductive surface whereby to transfer any toner image to said transfer medium, and (e) means to release the transfer medium from the photoconductive surface, K. said drying station having means for drying the photoconductive surface, L. said cleaning station having means for cleaning the photoconductive surface subsequent to transferring the toner image therefrom, M. said discharge station having means for discharging the photoconductive surface.

36. The apparatus as claimed in claim 35 wherein said means for applying heat and pressure include a rotatable transfer roller.

* * * * *

UNITED STATES PATENT AND TRADEMARK OFFICE

CERTIFICATE OF CORRECTION

PATENT NO. : 4,521,097

DATED : June 4, 1985

INVENTOR(S) : MANFRED R. KUEHNLE, et al

It is certified that error appears in the above-identified patent and that said Letters Patent are hereby corrected as shown below:

Column 9, line 42 "were" should be --wire--;

Column 9, line 57 "assebmly" should be --assembly--;

Column 16, line 13 (claim 17) before "source" --a-- should be inserted;

Column 18, line 3, (claim 18) "werein" should be --wherein--;

Signed and Sealed this

*Eleventh* Day of *March 1986*

[SEAL]

*Attest:*

DONALD J. QUIGG

*Attesting Officer*

*Commissioner of Patents and Trademarks*